United States Patent [19]

Davidson

[11] 4,326,360

[45] Apr. 27, 1982

[54] SHUTTER SHIELDS (R) VERTICAL TRAVEL ET AL.

[76] Inventor: James D. Davidson, 67 Grantour Ct., Pontiac, Mich. 48055

[21] Appl. No.: 64,354

[22] Filed: Aug. 7, 1979

[51] Int. Cl.[3] ..... E05B 65/04

[52] U.S. Cl. ..... 49/63; 49/419; 49/421

[58] Field of Search ..... 49/61, 63, 125, 417, 49/419, 414, 421

[56] References Cited

U.S. PATENT DOCUMENTS

| | | | |
|---|---|---|---|
| 3,219,100 | 11/1965 | Johnston et al. | 49/63 X |
| 3,240,258 | 3/1966 | Bianco | 49/63 X |
| 4,057,936 | 11/1977 | Wyatt, Jr. et al. | 49/DIG. 1 X |
| 4,083,148 | 4/1978 | Saucier | 49/63 X |
| 4,180,942 | 1/1980 | Saucier | 49/63 X |
| 4,267,666 | 5/1981 | Davidson | 49/449 X |

FOREIGN PATENT DOCUMENTS

| | | | |
|---|---|---|---|
| 715784 | 9/1954 | United Kingdom | 49/419 |

*Primary Examiner*—Kenneth Downey

[57] ABSTRACT

A thermal shutter device with vertical travel for use in combination with a window unit comprising a window frame & glass panels mounted in the window frame which is installed in a building outer periphery walls such as a dwelling, this device which is a thermal insulation construction comprising at least two thermal shutters with vertical travel & means to seal said thermal shutter device to create a sealed chamber between shutter device & window construction, the shutters can be of laminate construction with rigid insulation mounted in vertical track allowing shutters to slide up & down on compressible insulation slide means, when in closed mode they will greatly reduce heat transfer or infiltration either direction through said window construction, therefore reducing energy used to heat or cool said building, therefore helping our countries energy conservation program.

4 Claims, 18 Drawing Figures

3
29
28
13
12
25
3
13
24
100
4
2
2
11
23
22
37
20
90
4
27
31
21
5
26
15
10
31
5
16
14
15
29
27
13
29
27
100
37
21

35
34
24
22
31
37

14

SHUTTER SHIELDS (R) VERTICAL TRAVEL ET AL.

SUMMARY OF INVENTION

The prime object of this invention is to help our country's energy conservation program, by reducing the energy lost through glass areas in a building, such as a dwelling, said Thermal Shutter Device with vertical travel, will close off glass areas & create a sealed chamber between glass & shutter device reducing heat transfer or infiltration either direction through or around said glass areas commonly called a window, thereby reducing the energy used to heat or cool said building.

Many studies show 20 to 50% of the energy used in a building is lost through the glass areas, through the window frame & the cracks created by installing window in said buildings. Reference should be made to the prior co-pending continuing applications filed by Applicant, which are as follows:

Ser. No. 776,448 filed Mar. 10, 1977 (abandoned);
Ser. No. 912,186 filed June 5, 1978 (abandoned); and
Ser. No. 39,449 filed May 16, 1979 (approved); which the subject application is derived from.

Further object of this invention is to eliminate use of standard window shades & other devices known in the arts that keep out light, but do not conserve energy, we must conserve energy, if our Government desires conservation of energy they should treat thermal shutter devices for glass areas as important to our country's survival as black out curtains were in world war two, the difference would be that a thermal shutter will conserve energy forever when installed & closed, with a definite pay back to the user in actual monies, further object of this invention is to demonstrate two ways to install said invention on windows creating a sealed chamber between glass area & thermal shutter device.

A. Install directly to inside wall of building, completely encompassing said window construction including trim.
B. Install in opening for window frame defining a rough opening of window.

Either method will accomplish the same goal of conserving energy & reduce heating & cooling cost of said building, further object is to provide a device that will travel vertically & allow device to be installed on building wall encompassing said windows that have little room either side of window due to, kitchen cabinets etc. or windows in corners, further object is to provide a vertical travel means comprising a vertical slide track & a slide means attached to said shutter which allows a low friction means of travel but will apply pressure on slide track to hold shutters in any mode in said vertical slide track, further object is to provide a means to adjust said thermal shutter device to compensate for different trim thickness, sill thickness & rough openings or the like, further object of this invention is to provide a means to standardize shutter size to suit all like window sizes even though they are produced by different manufacturers, this is accomplished by adjustable track means, further object of invention is to provide a decorative means to protect said insulation material & still a further object is to provide a thermal shutter device which will deter crime of forcible entry through windows, even though this is not important to prime purpose of invention which is energy conservation.

BRIEF DISCRIPTION OF DRAWINGS

Figures 1, 2:
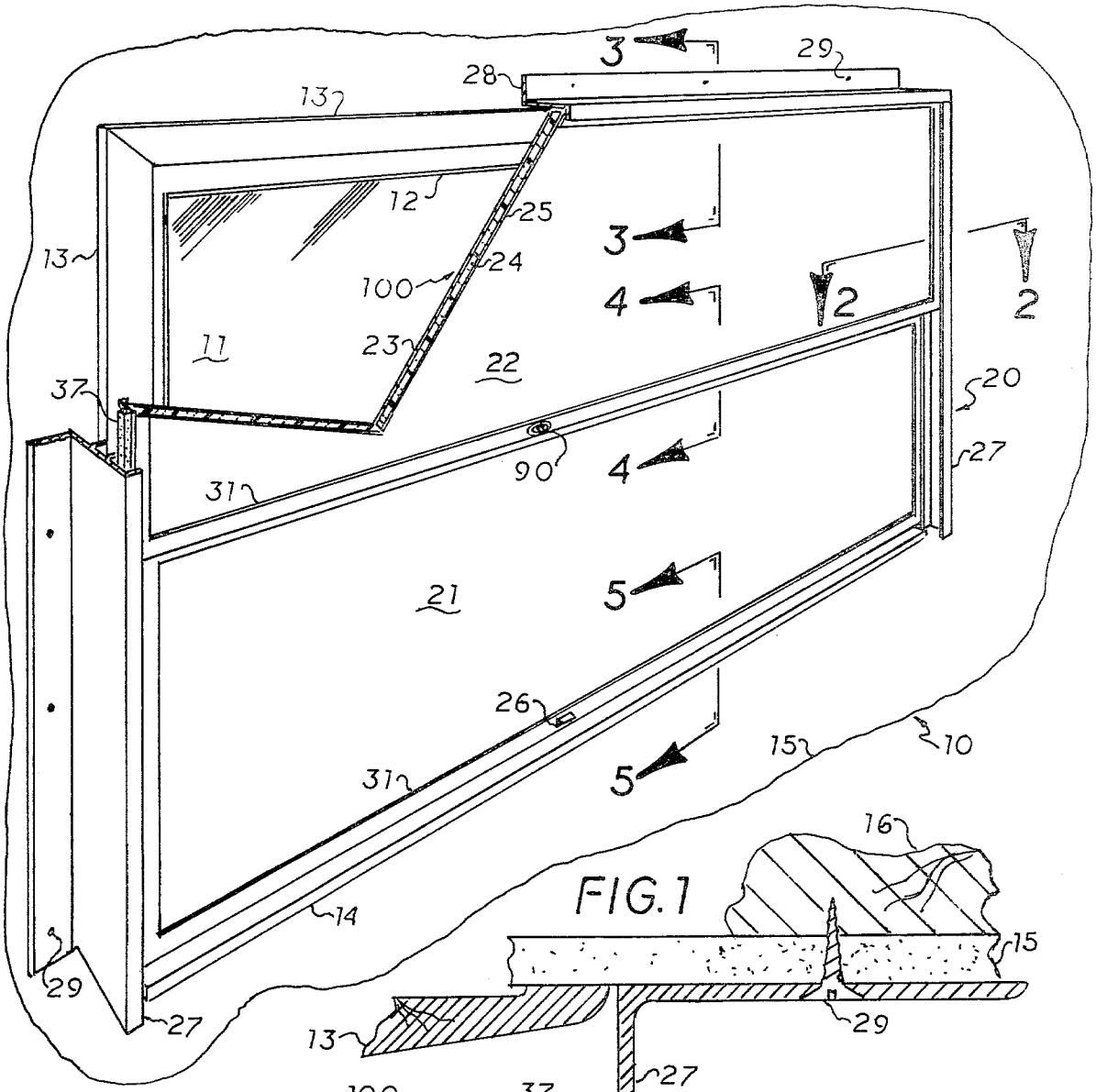
FIG. 1 is a perspective drawing with thermal shutters cut away to show window trim, window frame & window glass or glazing.
FIG. 2 is a section taken on line 2—2 FIG. 1 which shows how shutters slide in track & how thermal shutter device is attached to wall.
Figure 5A:
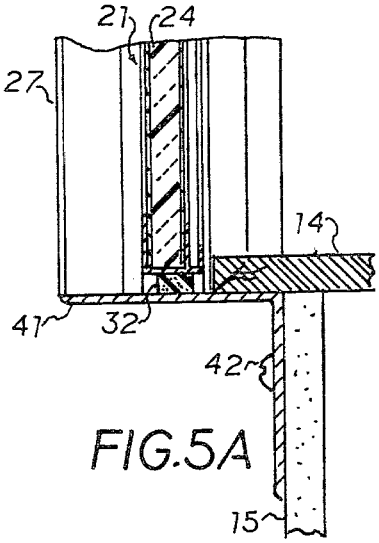
Figure 5:
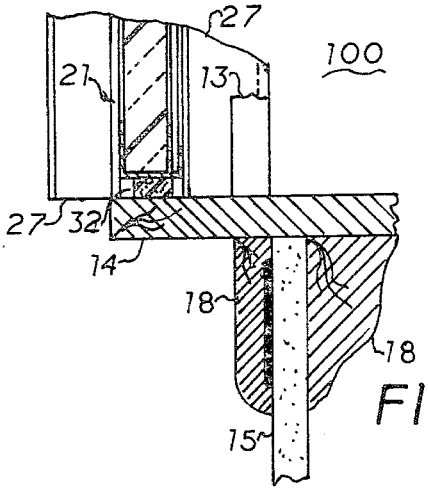

FIG. 5 is a section taken on line 5—5 of FIG. 1 which is at the sill area showing how thermal shutter is sealed in down closed position, also shows sealed chamber 100 & glass 11.

FIG. 5A is the same as FIG. 5 except shows how thermal shutter is sealed when a short window sill is used.

Figure 6:
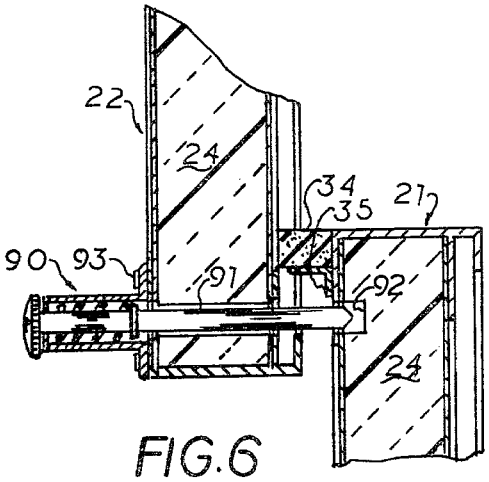

FIG. 6 illustrates a means to lock shutters in a closed position, also demonstrates a means to seal between thermal shutters.

Figure 7:
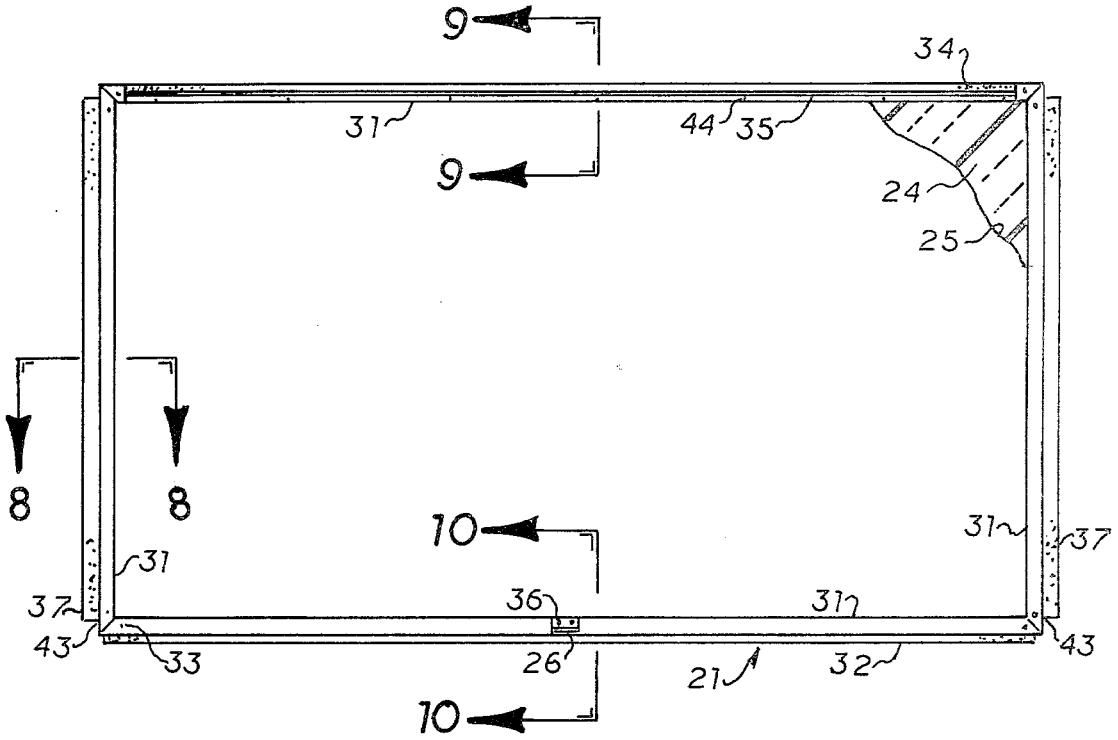

FIG. 7 is a typical plan view of a thermal shutter with protective cover cut away in right corner to show thermal insulation.

Figure 8:
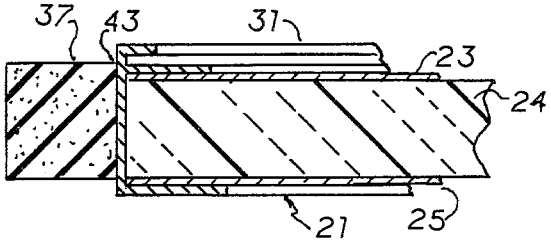

FIG. 8 is a section taken on line 8—8 of FIG. 7 which shows how slide means is attached to side of shutter.

Figure 9:
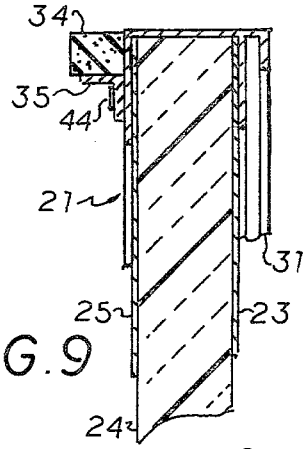

FIG. 9 is a section taken on line 9—9 FIG. 7 which shows seal means between shutters & thermal insulation inside shutter frame.

Figure 10:
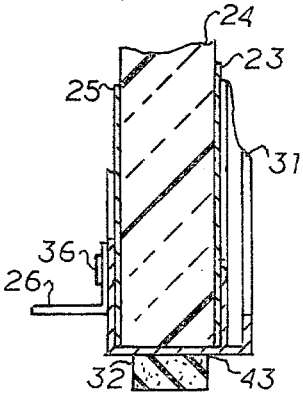

FIG. 10 is a section taken in line 10—10 of FIG. 7 which shows lower shutter with lift handle & seal means at bottom of shutter.

Figure 11:
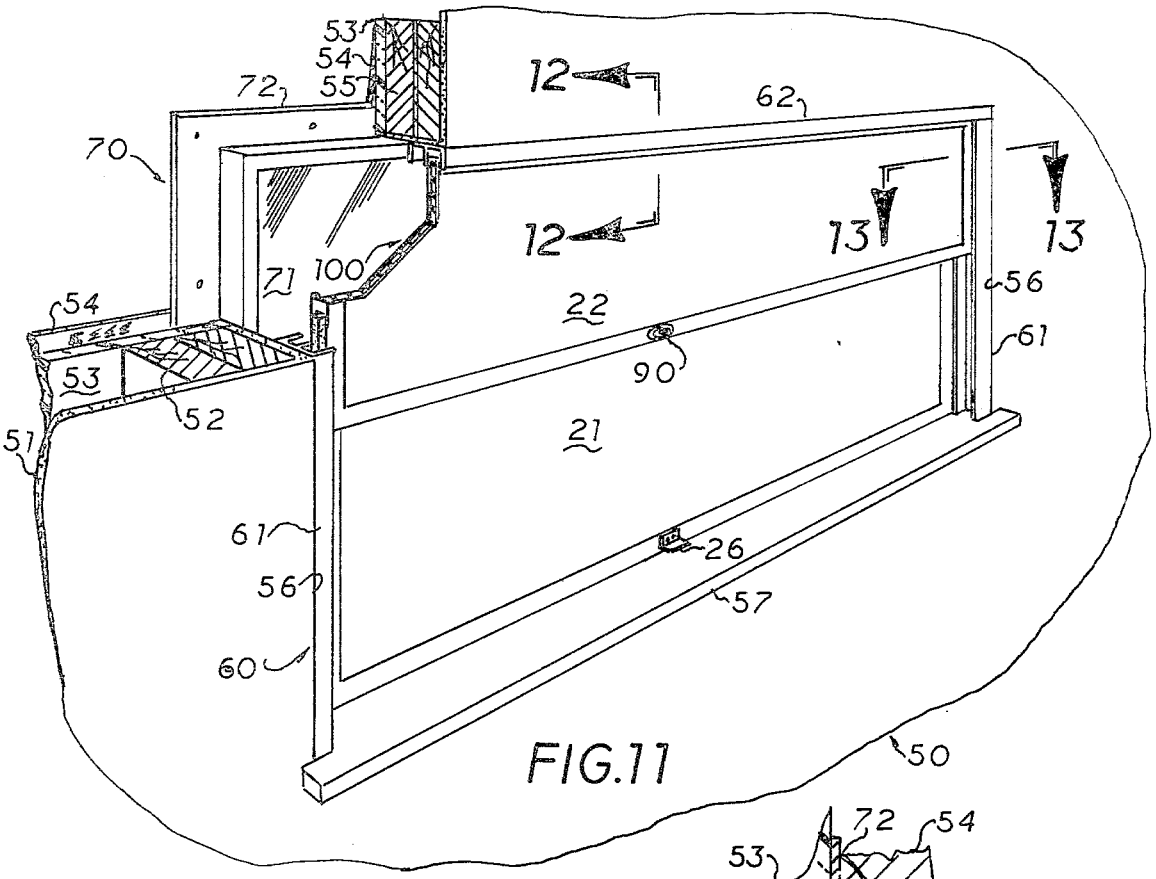

FIG. 11 is the same as FIG. 1 except FIG. 11 illustrates how thermal shutter device can be installed inside window frame opening, shutter has been cut away to show aluminum window frame & window glass & sealed chamber between window glass & thermal shutter device.

Figure 12:
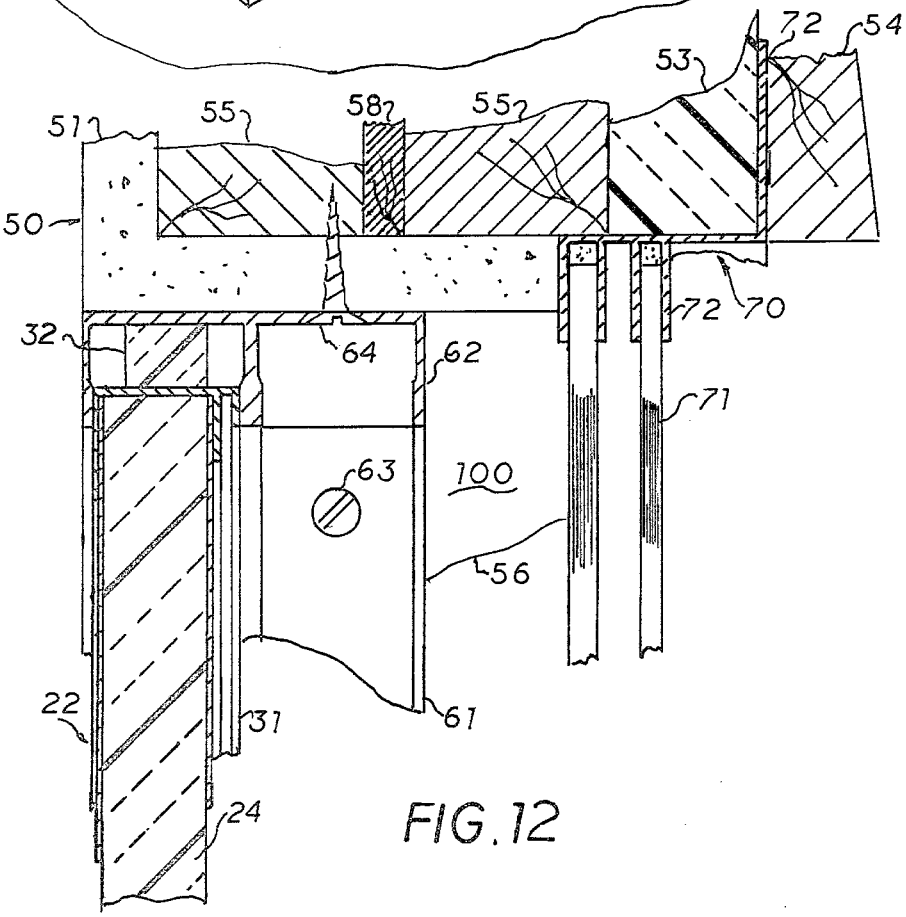

FIG. 12 is a section taken on line 12—12 FIG. 11 which shows how thermal shutter device is attached to top of window frame opening creating sealed chamber between thermal shutter device & window construction.

Figure 12A:
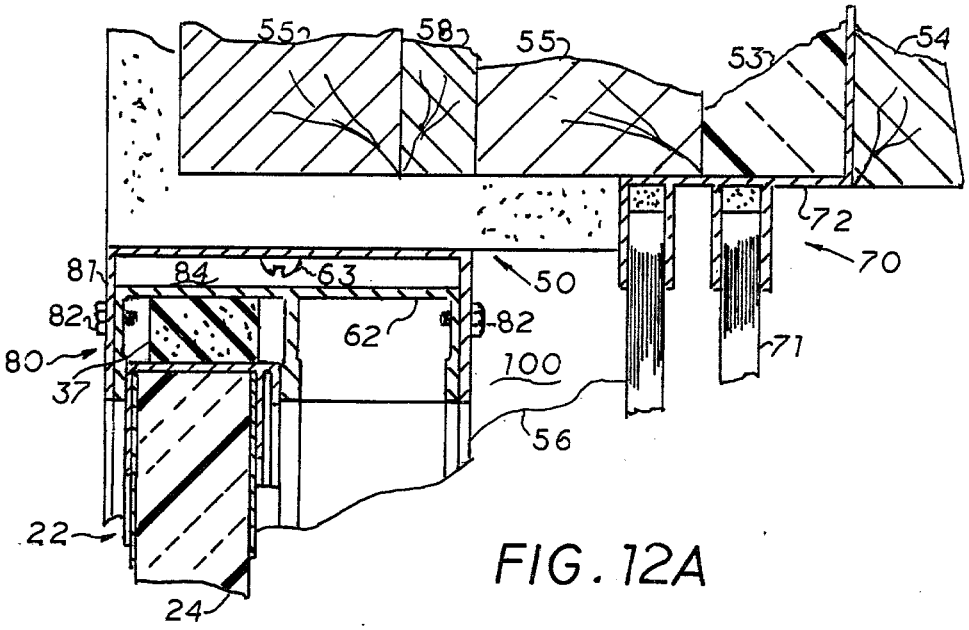

FIG. 12A is the same as FIG. 12 except a adjusting means has been added to allow for variance in window openings.

Figure 13A:
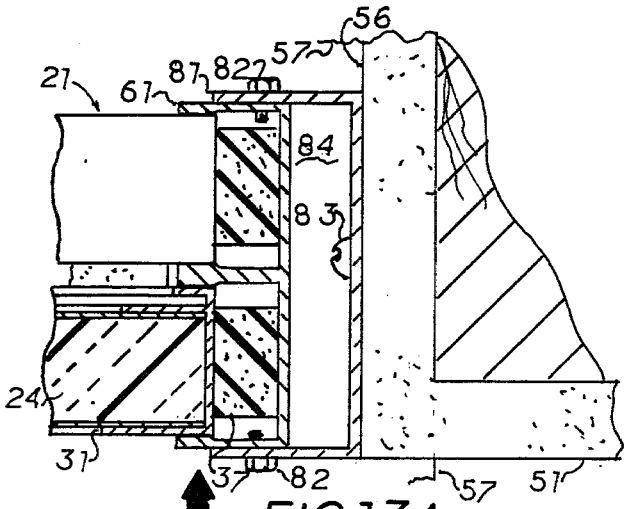
Figure 13:
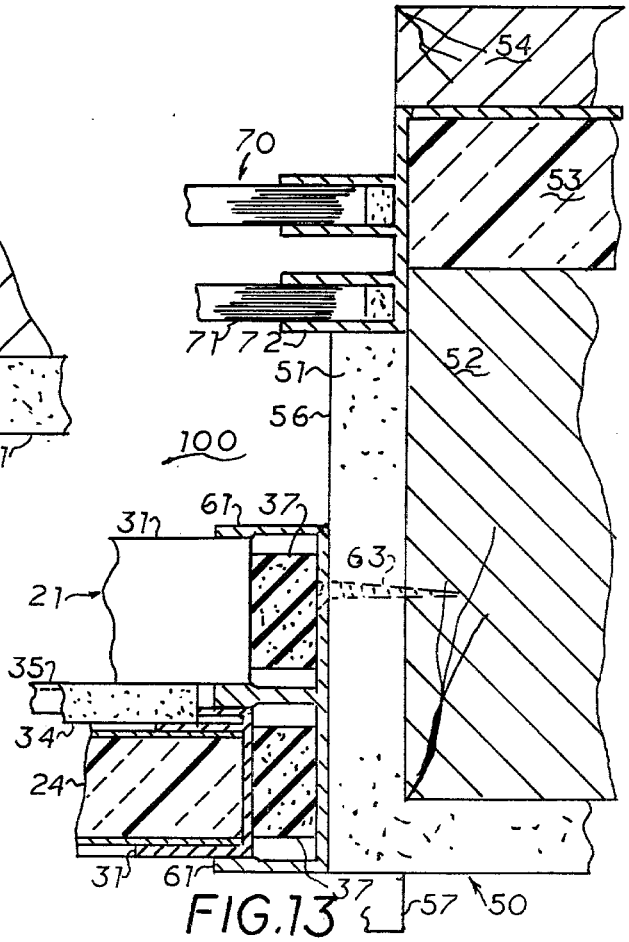

FIG. 13 is a section taken on line 13—13 FIG. 11 which illustrates how thermal device is attached to window side opening & sealed.

FIG. 13A is a section the same as FIG. 13 except a adjusting means is shown to take up variance in window openings.

Figure 14:
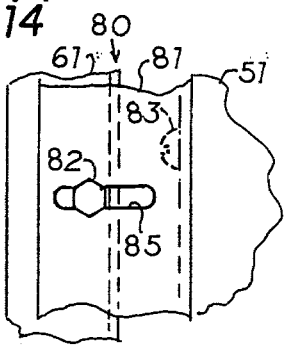

FIG. 14 is a view taken at arrow 14 which shows a adjusting means comprising a slotted hole & a metal fastener device.

DETAILED DISCRIPTION OF INVENTION

Reference is now made in great detail to FIGS. 1 through 14 of the drawings which are illustrative only & wherein like elements are designated by same reference numerals. FIG. 1 is a perspective view of a section of a building wall 10 such as a dwelling with a wood window frame construction 12 with glass 11 & window wood trim 13, completely encompassed by a thermal shutter device 20 attached to said building wall 10 on inside of said building, secured to drywall 15 with metal fastener 29 said fastener is inserted through drywall into building wall rough opening structural framing, thermal shutter 22 has been cut away to show how thermal shutters 22 & 21 create a sealed chamber 100 & prevent room air from making contact with glass 11 & cause heat to be transferred either direction through window area, FIG. 1 further shows how device 20 is attached to wall 10 at side of window with metal fastener 29, FIG. 1 further shows device 20 which comprises, thermal shutter 22 which can travel downward & thermal shutter 21 which can travel upward, vertical track 27 is cut away to illustrate how shutters 21 & 22 are contained in vertical track 27 which is a "U" shape design & shows low friction slide means 37 which also expands outward away from shutters 21 & 22 & holds shutters 21 & 22 in any up or down mode, FIG. 1 further illustrates when shutters 21 & 22 are in closed mode, shutter 21 is sealed on window sill 14, further shown is lift handle means 26 to lift said shutter 21 & a spring pin means 90 for locking said shutters 21 & 22 in closed mode & reduce heat transfer through window construction 12 & reduce infiltration around said window construction 12 therefore reducing energy used to heat or cool said building such as a dwelling, further shown in FIG. 1 is header seal bar 28 which is a "Z" bar fastened to wall 10 with metal fasteners 29 & seals across top of window, cut away further shows protective cover 23 for thermal insulation 24 which would reduce crime by preventing forcible entry through said device 20, further illustrated is decorative inner cover 25 which protects inner surface of insulation, FIG. 2 is a section taken on line 2—2 FIG. 1 which illustrates a one piece vertical track construction 27 which could be made from wood, metal, or plastic or the like, further illustrates a low friction slide means 37 which serves several purposes, A. A method for installing said thermal shutters 21 & 22 equadistant on vertical center line of said thermal shutter device 20.

B. Slide means 37 is maintained in a slightly compressed state which creates a outward pressure from vertical center line of said device 20, applying pressure to vertical track 27 & will hold said shutters 21 & 22 in any mode up or down or therebetween.

Figure 2A:
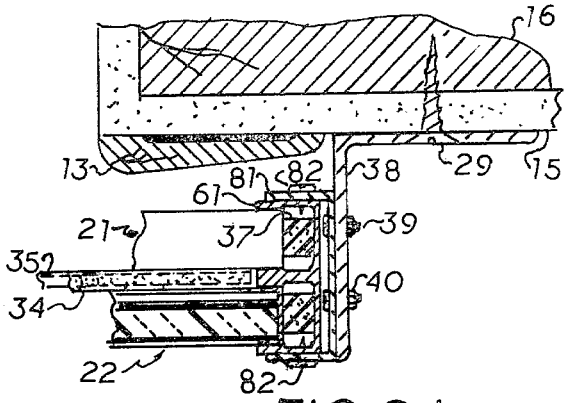
FIG. 2A is the same as FIG. 2 except 2A shows a adjustible track construction to allow for different window widths.

Low friction slide means 37 is attached to shutters 21 & 22 with adhesives or the like & slide means 37 can be made from any compressible expandable thermal insulating material, such as plastic foam, sponge rubber or the like, but must be compressible & always return to its free state, slide means 37 also emiminates using costly wheel & stop latch constructions & serves as insulation in said vertical track construction 27 reducing heat transfer & infiltration either direction through said vertical track 27, slide means 37 compresses easily facilitating installing or removing said shutters 21 & 22, FIG. 2 further illustrates how vertical track 27 is attached to drywall 15 with metal fasteners 29 to wall stud 16, further illustrated is wood trim 13 & sealed chamber 100, a means to adjust said shutter device 20 is shown in FIG. 2A which comprises the following articles, A. 90 degree wall mounting bracket 38 which can be made from wood, metal, plastic or the like & attached to drywall 15.

B. "U" channel 81 which is attached to 90 degree bracket 38 with metal fasteners 39 & 40 which are placed in slotted holes through bracket 38 allowing adjustment in or out from drywall 15, "U" channel 81 can be made from wood, plastic, metal or the like.

Figure 3:
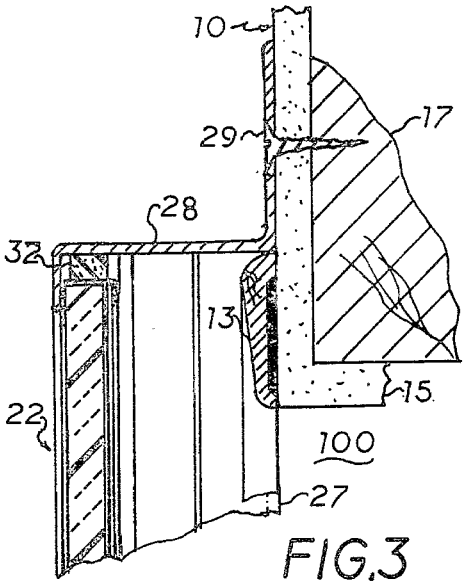
FIG. 3 shows a section taken at window header on line 3—3 FIG. 1 showing insulated shutter & how device is attached to building inner wall.
Figure 4:
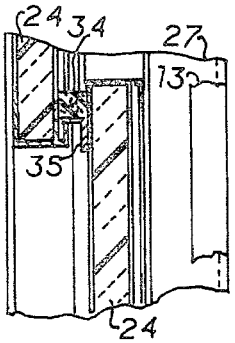
FIG. 4 is a section taken on line 4—4 of FIG. 1 which shows a seal means between thermal shutters.

C. Double track 61 can be made from plastic, metal or the like & attached to "U" channel 81 with metal fasteners 82 in slotted holes through "U" channel 81 which allows adjustment left ot right from vertical center line of said thermal shutter device 20, which compensates for different width of like size windows made by different window manufacturers, FIG. 3 illustrates a means to seal at window header 17 which comprises a header seal bar 28 which can be made from wood, metal, plastic or the like & is attached to wall 10 with metal fastener 29 through drywall 15 into window header 17, insulation 32 which can be made from plastic foam, sponge rubber or the like illustrates a means to seal at top of shutter 22 which helps to create sealed chamber 100 between shutter device 20 & window glass 11, FIG. 4 illustrates a means to seal between shutter 22 & shutter 21, seal means 34 can be made from plastic foam, sponge rubber or the like & attached to shutter 21 with adhesives or the like, FIG. 5 illustrates how shutter 21 is sealed on window sill 14 when shutter 21 is in closed mode, shutter 21 will apply pressure on seal 32 which is attached to shutter 21 with adhesives or the like, therefore sealing said shutter device 20 when in closed mode conserving energy, FIG. 5A is another means of sealing said shutter device 10 at window sill 14 with a 90 degree sill bracket 41 which can be made from wood, plastic, metal or the like which will compensate for windows with short sills etc., FIG. 6 illustrates a means 90 to lock shutters 21 & 22 in a closed mode which would create a problem for an intruder to attempt forcible entry through said shutter device 20, lock means 90 is a simple spring pin latch with a pin 91 which is allowed to penetrate into hole 92 in shutter 21, lock means 90 is attached to shutter 22 with metal fasteners 93, lock means 90 is a new use for spring pin constructions, further illustrated in FIG. 6 is seal means 34 & 90 degree bracket 35 which prevents objects used in forcible entry being easily pushed between shutters 21 & 22, FIG. 7 is a plan view of one means of constructing said thermal shutter 21 or shutter 22, protective cover 25 is a decorative material, such as wood, plastic, metal or the like & has been cut a way in right hand corner exposing hard board insulating material which is of rigid design & can be made from any insulation material such as polyurthane or the like, which is sandwiched between protective cover 25, & outer protective cover 23, which is not shown in FIG. 7, outer surface layer 23 can be made from wood, metal, plastic or the like & would help reduce & prevent forcible entry through shutters 21 & 22, but primarily its use is to protect insulation and adds rigidification material 24, further illustrated in FIG. 7 is shutter frame 31 which can be attached together with metal fasteners 33, such as pop rivets or adhesives, or both, further illustrated is slide means 37 on both vertical sides of shutter 21 attached with adhesives 43 or the like, sealer 32 is illustrated at bottom edge which is also attached to shutter 21 with adhesives 43 or the like, at this point shutters 21 & 22 would be the same, the difference would be sealer 34 & 90 degree bracket 35 & lift handle 26 would be added to shutter 21 & not needed on shutter 22, shutter frame 31 can be made from metal, plastic, wood or the like, FIG. 8 is a section taken on line 8—8 FIG. 7 which illustrates how slide means 37 is attached to shutter frame 31 with adhesives 43 or the like, further illustrated is protective cover 23 & decorative protective cover 25 with insulation 24 sandwiched between, FIG. 9 illustrates how sealer 34 is attached to shutter frame 31 & 90 degree bracket 35 is attached with metal fasteners 44 such as pop rivets or the like, FIG. 10 illustrates how lift handle 36, which can be made from plastic or metal and attached to shutter frame 31 with metal fastener 36 such as pop rivets or the like, purpose of illustrative drawing 1 through 14 are to show at least one means of manufacturing a thermal shutter device 20, but does not limit this invention to other methods of constructions for shutters 21 & 22, such as a spraying method, dipping method, vacuum forming or the like, two methods of installation are shown, FIG. 1 illustrates how shutter device 20 can be attached to inside building wall 10 encompassing said window, window framing window trim etc, FIG. 11 is the same as FIG. 1 except shutter device 60 is attached to inside of window frame rough opening 56 in building wall 50, vertical track 61 is attached to said window frame rough opening 56 with metal fasteners 63 said fasteners are installed into said building wall rough opening structural framing, shown in FIG. 11, shutter 22 is cut away to show window construction 70 with frame 72 & glass 71, shutters 21 & 22 are shown in a closed mode, header seal bar 62 is cut a way to illustrate how shutter 22 is entered into seal bar 62, further illustrated is building siding 54, building sheathing 53 & window header construction 55, window sill 57 & drywall 51 & building studs 52, FIG. 12 further illustrates how shutter device 60 is sealed at window header 55 comprising, a seal bar 62 made from wood, plastic, metal or the like, & shutter 22 is entered into seal bar 62 compressing insulation material 32, therefore reducing heat transfer or infiltration either direction through seal bar 62 area, further illustrated is metal fasteners 64 attaching said seal bar 62 to window header 55, further illustrated is vertical track 61 & means 63 to attach said vertical track 61 to window frame rough opening 56 defining sealed chamber 100 between window construction 70, glass 71 & shutter device 60 & shutter 22, FIG. 13 illustrates how vertical track 61 is attached to window frame opening 56 with metal fasteners 63, further shown is slide means 37, shutters 21 & 22 & sealed chamber 100 & window construction 70, FIG. 12A is a means 80 to adjust seal bar 62 up or down to ficilitate difference in window frame rough openings 56 which can vary from window to window even though window frame 70 are constructed by the same manufacturer, adjusting means 80, comprises; "U" channel 81 which can be made from wood, metal, plastic or the like & is attached to window frame opening 56 with metal fasteners 63, seal bar 62 is fastened to "U" bar 81 with metal fasteners 82 through slotted holes in "U" bar 81, when metal fasteners 82 are released seal bar 62 can move up or down to suit any size window opening, FIG. 13A illustrates how if adjusting means 80 is installed on at least one side of shutter device 60 in window frame opening 56, the shutter device 60 will adjust to fit all window openings of like size windows even though openings will vary from window to window, even in the same building, therefore providing a method of standardization of shutter device 60 to suit all like size windows even though they vary from manufacturer to manufacturer, further illustrated in FIG. 13A is air gap 84 which can be filled with insulation material to reduce heat transfer & infiltration through said air gap 84, FIG. 14 is a view taken in direction of arrow 14 FIG. 13A which shows adjusting device 80 with slotted hole 85 in "U" channel 81 with metal fastener 82 which holds vertical track 61 in place until released for adjustment, a brief summary of FIGS. 1 through 14 illustrates two ways of installing said shutter device 20 or 60 on inside walls, with adjustment up & down at header, & left & right adjustment from vertical center line of shutter device 20 or 60 to suit all like size windows regardless of manufacturer, said thermal shutter device 20 or 60 if installed & in closed mode will greatly reduce heat transfer & infiltration either direction through window constructions 12 or 70, thusly reducing energy used to heat or cool said building such as a dwelling & help our countries energy conservation program.

I claim:

1. An improved insulated shutter shield device in combination with a glass area mounted in a building structure having upright walls, said glass area including a glass area frame, said shutter shield device having track means spaced inwardly of and parallel to the plane of said glass area means;

laminate insulative shutter shield means mounted in said track means for movement between positions located above said glass area means and in front thereof, to block off the entirety of said glass area means, said laminate insulative shutter shield means including a frame movably supported in said track means and having an imperforate surface layer and an insulation material layer mounted side by side in the frame, said imperforate surface layer providing a surface against which is engaged with insulative material, said insulative material having little resistance against breakage when forces are applied in direction perpendicular to the plane thereof, said imperforate surface layer providing a protective barrier from the outside and a rigidification of said insulative material against the effects caused by forces applied from the outside in direction perpendicular to the plane thereof; and seal means for effecting a seal around the periphery of said glass area means and between said glass area means and said insulated shutter shield means, thereby defining a sealed chamber, wherein the improvement comprises:

means for mounting said track means in a parallel mode adjacent to the vertical side edges of said glass area frame means, spaced equadistant from the vertical center line of said glass area means, said track means being fastened to the building wall structural framing defining the building wall rough opening for receiving said glass area frame means;

means for mounting a horizontal header seal bar located above and at 90 degrees to said parallel vertical track means, said header seal bar is fastened to the building wall structural framing defined as the glass area rough opening header;

means for installing at least one stationary thermal shutter shield means in said vertical track means, closely fitted and sealed at said header seal bar, said stationary shutter shield means is maintained in a stationary mode in said track means, said maintaining means is a compressible expandable low friction slide means attached to the vertical sides of said insulated shutter shield device, compressed against said vertical track means, thereby preventing movement;

means for movably supporting at least one insulated shutter shield means in said vertical track means, said movable support means being compressible expandable low friction slide means, fastened to the vertical sides of said insulated shutter shield means and compressed against said vertical track means, maintaining said insulated shutter shield means equadistant around said device means vertical center line and in a stationary mode in any desired location in said vertical track means, said movable shutter shield means being manually movable to seal on said glass area sill means; and means for sealing between said stationary shutter shield means and said movable shutter shield means in a closed mode maintaining said sealed chamber.

2. An improved insulated shutter shield device as recited in claim 1, wherein the improvement comprises:

means for installing said insulated shutter shield device and means compensating for difference in glass area trim means and differences in building wall rough openings.

3. An improved insulated shutter shield means as recited in claim 1, wherein the improvement comprises:

means for installing and sealing the movable shutter in a closed mode when installed in combination with a glass area means not having a glass area sill means.

4. An improved insulated shutter shield device as recited in claim 1 having compressible expandable low friction slide means fastened to the vertical sides of said insulated shutter shield means, wherein the improvement comprises:

means for providing a low friction slide means from compressible expandable thermal insulation material.

* * * * *